US005531941A

United States Patent [19]

Poole

[11] Patent Number: 5,531,941

[45] Date of Patent: Jul. 2, 1996

[54] PROCESS FOR PREPARING AZIDE-FREE GAS GENERANT COMPOSITION

[75] Inventor: Donald R. Poole, Woodinville, Wash.

[73] Assignee: Automotive Systems Laboratory, Inc, Farmington Hills, Mich.

[21] Appl. No.: 467,182

[22] Filed: Jun. 6, 1995

Related U.S. Application Data

[62] Division of Ser. No. 101,848, Aug. 4, 1993, abandoned.

[51] Int. Cl.[6] ..... C06B 21/00

[52] U.S. Cl. ..... 264/3.4; 149/47; 149/109.6

[58] Field of Search ..... 149/47, 109.6; 264/3.1, 3.4

[56] References Cited

U.S. PATENT DOCUMENTS

| | | | |
|---|---|---|---|
| 2,923,612 | 2/1960 | Harrison et al. | 149/47 |
| 3,044,123 | 7/1962 | Grubaugh | 264/3.4 |
| 3,720,553 | 3/1973 | Henderson | 149/60 |
| 3,954,528 | 5/1976 | Chang et al. | 149/19.4 |
| 4,234,363 | 11/1980 | Flanagan | 149/19.4 |
| 4,552,736 | 11/1985 | Mishra | 149/19.4 |
| 4,925,600 | 5/1990 | Houmel et al. | 264/3.4 |
| 5,024,708 | 6/1991 | Gast et al. | 149/19.4 |
| 5,076,938 | 12/1991 | Chi | 149/19.4 |
| 5,125,684 | 6/1992 | Cartwright | 264/3.4 |

*Primary Examiner*—Edward A. Miller

[57] ABSTRACT

Gas generant compositions without highly toxic azides are provided which, upon combustion, are converted into gaseous products with only small amounts of solid combustion products thereby minimizing the gas filtration problem. A process for safely preparing gas generants which utilize the nitrogen containing fuel TAGN in the composition are provided. These compositions are especially suitable for inflating automotive and aircraft occupant restraint bags. The present invention advantageously and safely combines TAGN with phase stabilized ammonium nitrate (PSAN) to achieve production of a high volume of non-toxic gas with only small amounts of solid combustion products.

3 Claims, No Drawings

PROCESS FOR PREPARING AZIDE-FREE GAS GENERANT COMPOSITION

This is a divisional of application Ser. No. 08/101,848 filed on Aug. 4, 1993, and now abandoned.

BACKGROUND OF THE INVENTION

1. Field of the Invention

Inflatable devices for occupant restraint in vehicles or aircraft have been under development worldwide for many years. Patents have been granted on numerous gas generating compositions for inflating occupant restraint devices. Because of the strict requirements related to the nontoxic nature of the inflating gases most, if not all, gas generants now in use are based on azides, and especially sodium azide.

The use of sodium azide (or other azides) results in extra expense and risk in gas generant manufacture due to the extreme toxicity of azides. In addition, the potential hazard and disposal problem of unfired inflation devices must be considered. A nonazide containing gas generant is believed to provide significant advantages over an azide-based gas generant because of these toxicity related concerns.

An additional problem with azide-based gas generants is that they are relatively poor gas producers. Sodium azide, the primary gas source in azide-based gas generants, consists of only 64.6% nitrogen. In order to make a useful gas generant, however, other materials, such as oxidizers and slag formers must be added to the sodium azide. These additives produce little or no gas and therefore reduce the overall yield of gas to approximately 40 to 55% by weight (or approximately 1.3 to 2.0 moles of gas per 100 grams of gas generant).

The nongaseous fraction (45 to 60%) of the gas generant products must be contained or filtered in order to provide a clean inflating gas. This filter requires additional volume thereby increasing the size of the gas generator. The large fraction of nongaseous material is very hot and by remaining in the gas generator causes the gas generator to become hot and can result in a "soak back" temperature problem.

There are, therefore, several advantages to gas generants which produce more gas and less solids. Several attempts have been made to solve the problems mentioned above by the use of azide-free gas generants.

2. Description of the Prior Art

The compositions described in U.S. Pat. Nos. 4,909,549 and 4,948,439 describe the use of tetrazole or triazole compounds in combination with metal oxides and oxidizer compounds (alkali metal, alkaline earth metal, and ammonium nitrates or perchlorates) as gas generant compositions.

The compositions described in U.S. Pat. No. 5,035,757 result in more easily filterable solid products but the gas yield is without substantial improvement.

U.S. Pat. No. 3,954,528 describes the use of triaminoguanidine nitrate ("TAGN") and a synthetic polymeric binder in combination with an oxidizing material. The oxidizing materials include ammonium nitrate ("AN") although the use of phase stabilized ammonium nitrate ("PSAN") is not suggested. The patent teaches the preparation of propellants for use in guns or other devices where large amounts of carbon monoxide and hydrogen are acceptable and desirable.

U.S. Pat. No. 3,044,123 describes a method of preparing solid propellant pellets containing AN as the major component. The method requires use of an oxidizable organic binder (such as cellulose acetate, PVC, PVA, acrylonitrile and styrene-acrylonitrile), followed by compression molding the mixture to produce pellets and by heat treating the pellets. These pellets would certainly be damaged by temperature cycling because commercial AN is used and the composition claimed would produce large amounts of carbon monoxide.

U.S. Pat. No. 5,034,072 is based on the use of 5-oxo-3-nitro-1,2,4-triazole as a replacement for other explosive materials (HMX, RDX, TATB, etc.) in propellants and gun powders. This compound is also called 3-nitro-1,2,4-triazole-5-one ("NTO"). The claims appear to cover a gun powder composition which includes NTO, AN and an inert binder. Although called inert, the binder would enter into the combustion reaction and produce carbon monoxide making it unsuitable for air bag inflation.

U.S. Pat. No. 5,197,758 describes gas generating compositions comprising a non-azide fuel which is a transition metal complex of an aminoarazole, and in particular are copper and zinc complexes of 5-aminotetrazole and 3-amino-1,2,4-triazole which are useful for inflating airbags in automotive restraint systems.

In addition to U.S. Pat. Nos. 5,035,757 and 3,954,528 described herein-above the following U.S. Patents were cited in application Ser. No. 07/867,439 of which the present application is a continuation-in-part.

U.S. Pat. No. 4,931,112 describes an automotive airbag gas generant formulation consisting essentially of NTO (5-nitro-1,2,4-triazole- 3-one) and an oxidizer wherein said formulation is anhydrous.

U.S. Pat. No. 4,601,344 describes a gas generating composition containing glycidyl azide polymer and a high nitrogen content additive which generates large amounts of nitrogen gas upon burning and is useful to extinguish fires.

U.S. Pat. No. 4,234,363 describes a solid propellant hydrogen generator comprising an oxidizer, a fuel, and a binder such as a polyester binder said generator being useful for chemical laser systems.

U.S. Pat. No. 4,111,728 describes gas generators for inflating life rafts and similar devices or useful as rocket propellants comprising ammonium nitrate, a polyester type binder and a fuel selected from oxamide and guanidine nitrate.

U.S. Pat. No. 4,124,368 describes a method for preventing detonation of ammonium nitrate by using potassium nitrate.

U.S. Pat. Nos. 4,552,736 and 5,098,683 describe the use of potassium fluoride to eliminate expansion and contraction of ammonium nitrate in transition phase.

U.S. Pat. No. 5,074,938 describes the use of phase stabilized ammonium nitrate as an oxidizer in propellants containing boron and useful in rocket motors.

U.S. Pat. No. 4,925,503 describes an explosive composition comprising a high energy material, e.g., ammonium nitrate and a polyurethane polyacetal elastomer binder the latter component being the focus of the invention.

U.S. Pat. No. 3,071,617 describes long known considerations as to oxygen balance and exhaust gases.

U.S. Pat. No. 4,300,962 describes explosives comprising ammonium nitrate and an ammonium salt of a nitroazole.

U.S. Pat. No. 3,719,604 describes gas generating compositions comprising aminoguanidine salts of azotetrazole or of ditetrazole.

U.S. Pat. No. 5,034,072 describes the use of 5-oxo-3-nitro- 1,2,4-triazole, nitrocellulose and a liquid nitric ester for making gun powder said composition being less hygroscopic than a propellant containing ammonium nitrate.

U.S. Pat. No. 5,125,684 describes an extrudable propellant fuour use in crash bags comprising an oxidizer salt, a cellulose-based binder and a gas generating component.

U.S. Pat. No. 5,139,588 describes non-azide gas generants useful in automotive restraint devices comprising a fuel, an oxidizer and additives.

DETAILED DESCRIPTION OF THE PREFERRED EMBODIMENT OF THE INVENTION

Gas generant compositions without highly toxic azides are provided which, upon combustion, are converted into gaseous products with only small amounts of solid combustion products thereby minimizing the gas filtration problem. A process for safely preparing the gas generants are also provided. These compositions are especially suitable for inflating automotive and aircraft occupant restraint bags.

In one aspect, the invention comprises gas generant compositions. The principal advantage of the gas generant compositions of the invention is in the very high gas yields and consequently low yield of solid combustion products. Gas yields of greater than 90% by weight are obtained and consequently only 10% (at most) solid combustion products are produced. The actual yields are approximately 94% gas and 6% solids and are therefore much better than previous gas generants intended for automotive and aircraft air bag use. The high gas yield permits a smaller inflator and the low solid output allows a smaller and less expensive filter.

The invention in one preferred embodiment comprises an azide-free gas generant that produces exhaust gases on combustion for inflating vehicle or aircraft occupant restraint devices. The generant comprises a) PSAN as an oxidizer and b) at least one nitrogen containing fuel. A binder may be incorporated into the compositions of the present invention, however, the preferred embodiment is particularly unique in that it does not contain a binder. Fuels suitable in practicing the present invention are high in nitrogen content and low in carbon content to provide a high rate of burn and minimize the amount of carbon monoxide formed upon combustion.

Suitable fuels for use in the present invention are selected from TAGN, diaminoguanidine nitrate ("DAGN"), monoguanidine nitrate ("MAGN"), guanidine nitrate ("GN"), NTO and salts of NTO, urazole, triazoles, tetrazoles and salts of tetrazoles, oxamide, oxalyldihydrazide, melamine, pyrimidines, or mixtures of two or more of the group of fuels. A preferred fuel is TAGN or a mixture thereof with at least one other fuel, as described, where TAGN is in higher concentration. Preferably, the ratio of oxidizer to fuel is adjusted such that the amount of oxygen allowed in the equilibrium exhaust gases is from zero to 2 or 3% by volume, and more preferably from zero to 2.0% by volume. Preferably, the binder is selected from the group of binder polymers consisting of epoxy, polycarbonate, polyester, polyurethane, butadiene rubber, and mixtures of two or more of said polymers.

One preferred gas generant composition for air bag inflation comprises a mixture of a) PSAN, about 64.7 wt %, and b) TAGN, about 31.77 wt. %, and c) oxamide, about 3.53 wt %. Another preferred composition comprises a mixture of a) PSAN, about 59.3 to about 60.5 wt. %, and b) TAGN, about 39.5 to about 40.7 wt. %. Still another preferred composition comprises a) PSAN, about 59.4 wt. %, b) TAGN, about 32.48 wt. %, and c) GN, about 8.12 wt. %. Another example of a suitable composition is a) PSAN, about 52.5 wt. %, and b) NTO, about 47.5 wt %.

The gas generant compositions in another preferred embodiment are those. where the oxidizer and the fuel are mixed and compressed in pellet form, and the oxidizer is present in about 50 to 80% by weight such that on combustion the burning rate of the pellet composition is substantially greater than 0.3 inch per second at 1000 psi and more preferably 0.5 inch per second at 1000 psi.

The invention in another preferred aspect comprises a process for preparing an azide-free gas generant composition, comprising the steps of a) dissolving together weighed amounts of AN and potassium nitrate ("KN") in hot water, b) cooling and drying the resulting solution to obtain dry PSAN, c) grinding to a powder and weighing the thus obtained dry AN powder, d) drying and weighing the fuel comprising TAGN, e) mixing the dry AN powder and the dry fuel, f) grinding the resulting dry mixture to a powder, and g) molding the powder under pressure into pellets.

The invention in another preferred embodiment comprises a process for preparing an azide-free gas generant composition, comprising the steps of a) mixing weighed amounts of AN with TAGN and drying and grinding the resulting dry mixture to a powder, and b) molding the powder under pressure into pellets.

The invention in another preferred embodiment comprises a process for preparing an azide-free gas generant composition, comprising the steps of a) making TAGN that is wet with water or alcohol by a wet process, b) mixing weighed amounts of dry AN and dry KN with a weighed amount of said wet TAGN to obtain a wet gas generant mixture, c) drying and grinding the thus dried gas generant mixture to obtain a powder, and d) molding the powder under pressure into pellets.

The process for safely preparing the gas generants applies primarily to compositions using TAGN or mixtures of TAGN and other materials with AN or PSAN.

TAGN, when dry, is a class A or class 1.1 explosive with an impact sensitivity of approximately 45 kgcm and therefore presents a safety hazard for handling, transportation and storage. TAGN is usually shipped and stored while wet with water or alcohol to reduce the hazards.

TAGN can easily be made by several processes which are described in U.S. Pat. Nos. 5,041,661; 3,950,421; 3,285,958 and 4,800,232. These processes produce crystalline TAGN which is washed and dried in the final stages of the process. Instead of drying the TAGN, if it is mixed, while still wet, with AN or a combination of AN and a potassium salt, the TAGN is converted to a less sensitive mixture thereby avoiding the problem of handling dry TAGN. This method also avoids a separate process for making PSAN. The primary advantage is not having to dry out and handle a sensitive explosive in the dry state.

Oxidizer

The oxidizer (PSAN) provides the oxygen to convert all carbon to carbon dioxide and hydrogen to water. One of the major problems with the use of AN is that it undergoes several crystalline phase changes. One of these phase changes occurs at approximately 32° C. and is accompanied by a large change in volume. If a gas generant containing a significant amount of AN is thermally cycled above and below this temperature, the AN crystals expand and contract and change shape resulting in growth and cracking in the gas generant. This is totally unacceptable in a gas generant used in air bag inflators because the burning characteristics would be altered such that the inflator would not operate properly or might even blow up because of the excess pressure generated. In order to avoid this problem it is essential that only PSAN is used.

Several methods of phase stabilizing AN are known. It is well known for example that potassium incorporated into the crystal structure is effective in phase stabilizing AN. Most commonly 8 to 15% by weight of KN is added to AN in aqueous solution for this purpose although other potassium salts also effect stabilization.

Other methods of phase stabilizing AN include the use of desiccants and other coatings on the AN particles.

The unique feature of AN is that it is the only known oxidizer with acceptable physical properties (except for the phase change problem) for air bag gas generant usage which produces no solid residue or large amounts of toxic gases. Ammonium perchlorate produces no solid residue but produces large amounts of toxic hydrogen chloride.

The amount of solid residue produced by PSAN is directly dependent upon the method of stabilization but most methods produce less solid residue than would be produced by more conventional oxidizers such as sodium nitrate or potassium perchlorate. While PSAN is essential, any method which works and does not produce toxic products is contemplated by the invention. For example, mixing an appropriate amount of potassium oxalate with AN would be such an appropriate method.

The amount of oxidizer needed is dependent on the type of fuel used and can be determined readily by one skilled in the art based on the oxygen balance of the fuel. The oxidizer and fuel ratio is adjusted so that there is a small excess of oxygen in the product gases in order to minimize the amount of carbon monoxide produced. A large excess of oxygen is avoided in order to limit the amount of $NO_x$ produced.

Fuel

The fuel component of the gas generant may be selected from various nitrogen containing components such as TAGN, DAGN, MAGN, NTO, salts of NTO, urazole, triazoles, tetrazoles, GN, oxamide, oxalyldihydrazide, melamine, various pyrimidines, and mixtures of these compounds.

Obviously, some of these fuels are more desirable than others. In general, compounds having high nitrogen and low carbon content are best. TAGN is also valuable because it increases the burn rate of AN/fuel mixtures. Gas generants using AN as the oxidizer are generally very slow burning with burning rates at 1000 psi typically less than 0.1 inch per second. In air bag gas generants burning rates of less than about 0.4 to 0.5 inch per second are difficult to use. Because of its effect on burning rate, TAGN and mixtures of TAGN with other fuels, where TAGN has the higher concentration, are preferred.

As mentioned above, the fuel concentration is correlated with the oxidizer concentration so as to produce a small amount of oxygen in the combustion products. This range of fuel is therefore generally from about 20 to 50% by weight depending on the ratio of carbon, hydrogen and oxygen in the fuel molecule.

Binder

A binder is not essential in most formulations where the strength of the gas generant pellets of grains is adequate. For some formulations or for certain gas generant forms where additional strength is needed, however, a binder may be required or desirable.

Organic polymeric binders such as epoxy, polycarbonate, polyesters, polyurethane or butadiene rubber are useful in these compositions.

Because of the large amount of carbon in organic polymers, their use in gas generants for automotive air bags must be limited to lower levels than in more conventional propellants. In those compositions of the present invention wherein a binder is employed the amount of binder would be no more than about 12% by weight, and is more likely to be in the range of about 2% to 10% by weight when used with stabilized AN oxidizer.

The invention and the best mode of practicing the same are described in the following illustrative examples.

EXAMPLE 1

A quantity of PSAN was prepared by heating a mixture of 85% AN and 15% KN with enough water to dissolve all of the solid AN and KN when heated to about 80° C. The solution was then stirred while cooling to room temperature. The resulting moist solid was then spread out in a thin layer and dried in an oven at 80° C. After drying, the solid material was ground in a simple laboratory grinder resulting in a fine granular material.

A mixture of the PSAN and NTO was prepared having the following composition in percent by weight: 52.5% PSAN and 47.5% NTO. These granular solids were blended and ground to fine powders in a ball mill, and pellets were formed by compression molding.

The burning rate of this composition was found to be 0.63 inch per second at 1000 psi. The burning rate was determined by measuring the time required to burn a cylindrical pellet of known length. The pellets were compression molded in a half-inch diameter die at approximately 16,000 pounds force and were then coated on the sides with an epoxy-titanium dioxide inhibitor which prevented burning along the sides.

The pellet forming ability of this composition was tested by compression molding pellets on a high-speed tableting press. The material was found to form pellets of excellent quality. Pellets thus formed were-tested in a gas generator designed to simulate an actual air bag inflator and were found to function satisfactorily.

EXAMPLE 2

A mixture of PSAN and TAGN was prepared having the following composition in percent by weight: 60.4% PSAN and 39.6% TAGN. This gas generant composition was prepared by dissolving the required amount of AN (51.34%) and KN (9.06%) in water while heating to 60° to 80° C., adding the TAGN and cooling while stirring. The resulting moist solid was spread out in a pan and dried in an oven at 80° C. The dried material was delumped by passing through a 12 mesh sieve and was then blended and ground to a fine powder in a ball mill.

The burning rate of this composition was found to be 0.83 inch per second at 1000 psi when compression molded and measured as described in Example 1.

The pellet forming ability of this composition was tested by compression molding pellets on a high-speed tableting press. The material was found to form pellets of excellent quality. Pellets formed in this manner were tested in a gas generator designed to simulate an actual air bag inflator and were found to function satisfactorily.

EXAMPLE 3

A mixture of PSAN and TAGN was prepared having the following composition in percent by weight: 50.4% AN, 8.9% KN and 40.7% TAGN. This gas generant composition was prepared and tested as described in Example 2 and the burning rate was found to be 0.78 inch per second at 1000 psi.

EXAMPLE 4

A mixture of PSAN, TAGN and GN was prepared having the following composition in percent by weight: 59.40% PSAN, 32.48% TAGN and 8.12% GN.

This gas generant composition was prepared by dissolving the required amount of AN (50.49%) and KN (8.91%) in water while heating to 60° to 80° C., adding the TAGN and GN and cooling while stirring. The resulting moist solid was spread out in a pan and dried in an oven at 80° C. The dried material was delumped by passing through a 12 mesh sieve and was then blended and ground to a fine powder in a ball mill.

The burning rate of this composition was found to be 0.76 inch per second at 1000 psi when compression molded and measured as described in Example 1.

EXAMPLE 5

A mixture of PSAN, TAGN and oxamide was prepared having the following composition in percent by weight: 55.16% AN, 9.74% KN, 7.02% oxamide and 28.08% TAGN. This gas generant composition was prepared by the method described in Example 4.

The burning rate of this composition was found to be 0.59 inches per second at 1000 psi when compression molded and tested as described in Example 1.

EXAMPLE 6

A mixture of PSAN and TAGN was prepared having the following composition in percent by weight: 54.45% AN, 6.05% KN and 39.50% TAGN.

In this example the amount of KN was reduced to 10% of the AN/KN mixture whereas in previous examples the amount of KN used was 15% of the AN/KN mixture.

This gas generant was prepared and tested as described in Example 2 and the burning rate was found to be 0.75 inches per second at 1000 psi.

EXAMPLE 7

A mixture of PSAN, TAGN, and oxamide was prepared having the following composition in percent by weight: 64.7% PSAN, 31.77% TAGN, and 3.53% oxamide. This gas generant composition was prepared by the method described in Example 4.

The burning rate of this composition was found to be 0.59 inches per second at 1000 psi when compression molded and tested as described in Example 1.

Having thus described my invention, the embodiments in which an exclusive property or privilege is claimed are defined as follows.

I claim:

1. A process for preparing an azide-free gas generant composition that produces exhaust gases on combustion for inflating vehicle or aircraft occupant restraint devices, said composition comprising a mixture of phase stabilized ammonium nitrate (PSAN) and triaminoguanidine nitrate (TAGN), said process comprising the steps of (a) mixing weighed amounts of ammonium nitrate and potassium nitrate with wet triaminoguanidine nitrate and drying and grinding the resulting dry mixture to a powder, and (b) molding the powder under pressure into pellets.

2. A process for preparing an azide-free gas generant composition that produces exhaust gases on combustion for inflating vehicle or aircraft occupant restraint devices, said composition comprising a mixture of phase stabilized ammonium nitrate (PSAN) and triaminoguanidine nitrate (TAGN), said process comprising the steps of (a) making triaminoguanidine nitrate that is wet with water or alcohol by a wet process, (b) mixing weighed amounts of dry ammonium nitrate and dry potassium nitrate with a weighed amount of triaminoguanidine nitrate to obtain a wet gas generant mixture, (c) drying and grinding the thus dried gas generant mixture to obtain a powder, and (d) molding the powder under pressure into pellets.

3. The process according to claim 1 or 2 wherein the ratio of PSAN to TAGN is adjusted such that upon combustion the amount of oxygen allowed in the equilibrium exhaust gases is less than 2.0% to 3.0% by volume.

* * * * *